United States Patent [19]

Arnott

[11] Patent Number: 4,603,861

[45] Date of Patent: Aug. 5, 1986

[54] BOWLING BALL

[76] Inventor: Walter Arnott, 720 Carrollwood Village, #305, Gretna, La. 70053

[21] Appl. No.: 650,882

[22] Filed: Sep. 17, 1984

[51] Int. Cl.[4] ..... A63B 37/00; A63B 37/08

[52] U.S. Cl. ..... 273/63 R; 273/58 H

[58] Field of Search ..... 273/63 E, 63 D, 63 R, 273/58 F, 58 H, 128 A

[56] References Cited

U.S. PATENT DOCUMENTS 1,849,414 3/1932 Turnbull ..... 273/63 E 2,361,423 10/1944 Snyder ..... 40/410

3,517,933 6/1970 Malkin ..... 273/63 E 3,655,197 4/1972 Milbaum ..... 273/58 H X

*Primary Examiner*—George J. Marlo

*Attorney, Agent, or Firm*—Keaty & Keaty

[57] ABSTRACT

A bowling ball having a spherical solid core and a spherical mantle which is hollow in the center to accommodate the core in closely adjacent surrounding relationship. A layer of lubricant, such as oil or polytetrafluoroethylene, around the core allows for independent rotation of the core and the mantle to increase the "mixing" action of the ball then it strikes the pins due to separation of active and passive masses of the mantle and the core.

8 Claims, 3 Drawing Figures

BOWLING BALL

BACKGROUND OF THE INVENTION

1. Field of the Invention

This invention relates to bowling balls, particularly bowling balls having a structure giving rise to a gyroscopic effect.

2. Discussion of the Prior Art

Bowling is a sport which has been enjoyed by participants for many years. Conventional bowling balls are solid, spherical structures, usually comprised of resinous materials which are provided with three finger holes. Proponents of the sport have long sought a bowling ball having gyroscopic properties which would tend to increase the "mixing" action of the ball as it hits the pins. The mixing action refers to the spinning of the ball as it strikes the bowling pins, which spinning gives rise to an increased number of pins being knocked down.

U.S. Pat. Nos. 3,865,369 and 4,264,071 disclose bowling balls having an internal weight of such a shape that the center of mass of the ball is not at the geometric center. A substantial part of the weight is closer to the surface than to the center so that it exerts a "flywheel" effect on the ball as it rolls.

U.S. Pat. No. 4,183,527 discloses a bowling ball having a gyroscopic effect as a result of the ball being comprised of several segments of material having differing densities.

U.S. Pat. No. 4,268,034 discloses a bowling ball having a hollow member, or a member of less specific gravity than the mass of a bowling ball, with its centroid displaced from the geometric center of the ball.

None of the aforementioned devices, however, give rise to a truly dramatic gyroscopic effect which would produce maximum mixing action and result in the highest score for a bowler.

SUMMARY OF THE INVENTION

Accordingly, it is an object of the present invention to provide a bowling ball having maximum gyroscopic effect which results in the largest number of bowling pins being struck down.

This object is achieved by providing a convention bowling ball having a spherical solid core, a separate solid mantle surrounding the core and presenting a substantially spherical surface on which the ball rolls, and a layer of lubricant between the core and mantle for facilitating independent rotation of the core and mantle. In preferred embodiments, the lubricant layer is comprised of polytetrafluoroethylene (Teflon ®) or oil.

DETAILED DESCRIPTION OF THE INVENTION

Figure 1:
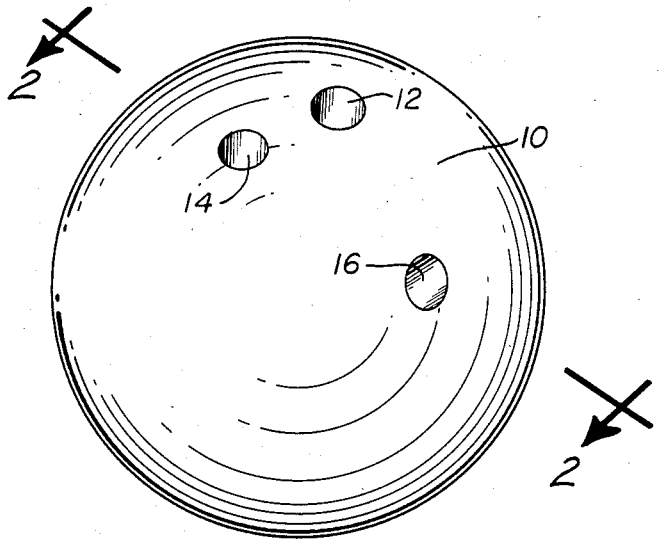
FIG. 1 is a perspective view of a bowling ball showing the three conventional finger holes.

Referring now to FIG. 1, a bowling ball 10 is shown which is provided with three finger holes, 12, 14, 16. Ball 10 is made of a conventional material for making bowling balls, such as methacrylate, or any other suitable material.

Figure 2:
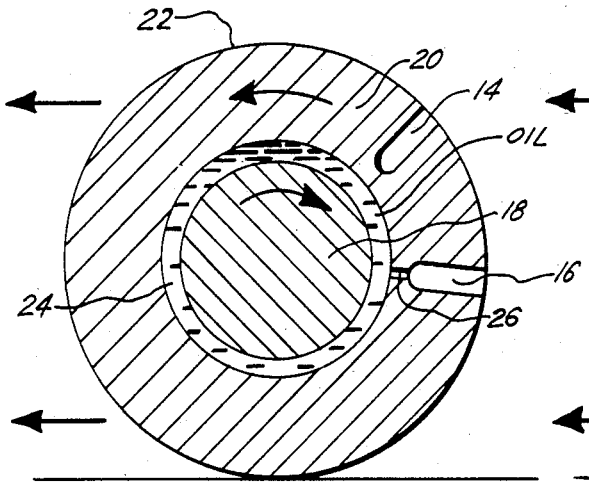
FIG. 2 is a cross-sectional view taken along section lines 2—2 in FIG. 1 showing a first embodiment of the ball in which the layer of lubricant is a liquid oil.

In the first embodiment of the invention shown in FIG. 2, bowling ball 10 comprises a spherical solid core 18 surrounded by a separate solid mantle 20. Mantle 20 presents a substantially spherical rolling surface 22 on which ball 10 rolls. In preferred embodiments of the invention, the ratio of the weight of mantle 20 to the weight of core 18 is approximately 1:1 since this distribution of weight has been found to give rise to a particularly superior gyroscopic action.

A layer of oil 24 is provided between core 18 and mantle 20 for facilitating independent rotation of core 18 and mantle 20. The oil can be any of numerous unctuos combustible substances that are liquid or at least easily liquifiable on warming. Especially preferred are petroleum based oils of the kind used for lubricating moving parts.

In the embodiment of the invention shown in FIG. 2, a selectively closed passageway 26 is provided from the terminus of hole 16 to layer 24. This passageway can be provided with a plug or other means for closing it. When the passageway is open, it provides a bore through which oil can be supplied to layer 24, either to initially place the oil in the ball or to replenish or replace layer 24.

Figure 3:
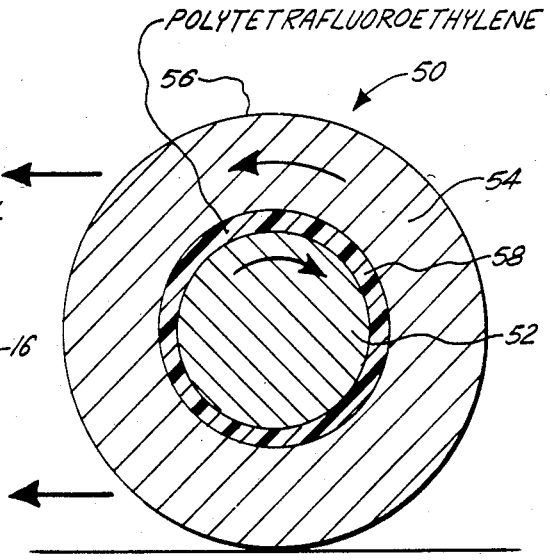
FIG. 3 is a view similar to FIG. 2, showing however a second embodiment of the ball in which the lubricant layer is Teflon ® (polytetrafluoroethylene).

In the embodiment of the invention shown in FIG. 3, a bowling ball 50 is shown which is similar to ball 10 described above. It comprises a spherical solid core 52 surrounded by a solid mantle 54, the mantle presenting a substantially spherical surface 56 on which ball 10 rolls. In preferred embodiments, the ratio of the weight of mantle 54 to the weight of core 52 is approximately 1:1 to provide maximum gyroscopic effect.

A layer of resinous lubricant, such as polytetrafluroethylene, which can be obtained as Teflon ® from E. I. DuPont de Nemours and Co., 58, is disposed between core 52 and mantle 54 for facilitating independent rotation of core 52 and mantle 54.

In operation, a user's thumb is placed in hole 16 and the middle and ring fingers in holes 14 and 12 respectively. Ball 10 is then thrown in the conventional manner in which it is lifted upwardly and outwardly with the thumb first coming out of the ball causing the ball to roll off of the palm and onto the two fingers. With the upward lift continuing, the fingers leave the ball and the ball commences to roll down the alley.

The mantle will rotate freely about the core, as the ball rolls down the alley, because all of the upward lift was applied to the mantle (into which the holes are drilled) and none to the core due to the field of lubrication separating the two masses. Due to friction, which any lubricant can only minimize and not eliminate, the core will eventually assume the rotation of the mantle but that is negligible for the purposes stated.

It is this separation of active and passive masses, mantle and core respectively, that will cause more "mixing" action as the torque generated by the mantle creates a cyclonic effect.

This distribution and utilization of active and passive masses is currently the most effective construction of a bowling ball for maximum ball/pins interaction, thus resulting in better scores.

I claim:

1. A bowling ball comprising:

a homogeneous non-hollow solid core in the shape of a sphere;

a mantle in the shape of a sphere having an inner surface surrounding said core and generally concentric with said core and presenting a substantially spherical surface on which said ball rolls; and a layer of lubricant between said core and mantle for facilitating independent rotation of said core and mantle.

2. The bowling ball of claim 1, wherein said lubricant is polytetrafluoroethylene.

3. The bowling ball of claim 1, wherein said lubricant is oil.

4. The bowling ball of claim 3, wherein a selectively closed passageway is provided from the exterior of said mantle to said layer for providing lubricant to said layer.

5. The bowling ball of claim 1, wherein the ratio of the weight of said mantle to the weight of said core is substantially 1:1.

6. A bowling ball comprising:

a homogeneous solid non-hollow core in the shape of a sphere;

a mantle in the shape of a sphere with a hollow center in the shape of a sphere accommodating the core in closely adjacent surrounding relationship; and a layer of lubricant between the core and the mantle for facilitating independent rotation of said core and the mantle.

7. The bowling ball of claim 6 wherein said lubricant is polytetrafluoroethylene.

8. The bowling ball of claim 6 wherein said lubricant is oil.

* * * * *